US009786993B1

(12) United States Patent
Koslover

(10) Patent No.: US 9,786,993 B1
(45) Date of Patent: Oct. 10, 2017

(54) STEERABLE HIGH-POWER MICROWAVE ANTENNAS

(71) Applicant: SCIENTIFIC APPLICATIONS & RESEARCH ASSOCIATES, INC., Cypress, CA (US)

(72) Inventor: Robert A. Koslover, Tyler, TX (US)

(73) Assignee: SCIENTIFIC APPLICATION & RESEARCH ASSOCIATES, INC., Cypress, CA (US)

( * ) Notice: Subject to any disclaimer, the term of this patent is extended or adjusted under 35 U.S.C. 154(b) by 376 days.

(21) Appl. No.: 14/678,835

(22) Filed: Apr. 3, 2015

Related U.S. Application Data

(60) Provisional application No. 61/974,644, filed on Apr. 3, 2014.

(51) Int. Cl.

| | |
|---|---|
| ***H01Q 13/28*** | (2006.01) |
| ***H01Q 15/24*** | (2006.01) |
| ***H01Q 13/22*** | (2006.01) |
| ***H01Q 19/18*** | (2006.01) |

(52) U.S. Cl.
CPC ..... *H01Q 13/28* (2013.01); *H01Q 13/22* (2013.01); *H01Q 15/248* (2013.01); *H01Q 19/18* (2013.01)

(58) Field of Classification Search
CPC ..... H01Q 13/28; H01Q 13/22; H01Q 15/248; H01Q 19/18
USPC ..... 343/781
See application file for complete search history.

(56) References Cited

U.S. PATENT DOCUMENTS

2011/0163930 A1* 7/2011 De Lustrac ..... H01Q 15/148 343/777
2012/0320586 A1* 12/2012 Yip ..... F21V 7/06 362/241

* cited by examiner

*Primary Examiner* — Dameon E Levi
*Assistant Examiner* — Andrea Lindgren Baltzell
(74) *Attorney, Agent, or Firm* — Stetina Brunda Garred & Brucker

(57) ABSTRACT

A steerable, high-power microwave antenna includes: a forward-traveling, leaky-wave feed antenna; a trans-reflecting conical-sectional reflector disposed spaced-apart and above said leaky-wave feed antenna and having a conical surface facing said leaky-wave feed antenna and formed of a plurality of electrical conductors held in parallel order in a grill; and a twist-reflector pivotally mounted opposite and spaced-apart from said conical surface of said trans-reflecting conical-sectional reflector. The twist-reflector is adapted to receive microwave energy reflected to it from said conical surface of said trans-reflecting conical-sectional reflector and to rotate the polarization of said microwave energy and reflect said microwave energy back to said trans-reflecting conical-sectional reflector for passing through said trans-reflecting conical-sectional reflector and forming a narrow, pencil-like beam of high energy radiation in polarized form extending outward from said conical surface of said trans-reflecting conical-sectional reflector.

9 Claims, 19 Drawing Sheets

$$A = \frac{\phi_0}{2}\left(r_c^2 - r_h^2\right)$$

$$\vec{E} = E_0\hat{x}$$

$$G_{ideal} = \frac{4\pi A}{\lambda^2} = \frac{2\pi\phi_0\left(r_c^2 - r_h^2\right)}{\lambda^2}$$

→ Ap efficiency = 100%

$$\vec{E} = E_0\hat{\phi}$$

$$G_{curvy} = \frac{4\pi\left(r_c^2 - r_h^2\right)\left(1 - \cos\phi_0\right)}{\lambda^2\phi_0}$$

→ Ap efficiency $$= \frac{G_{curvy}}{G_{ideal}} = \frac{2\left(1 - \cos\phi_0\right)}{\phi_0^2}$$

STEERABLE HIGH-POWER MICROWAVE ANTENNAS

CROSS-REFERENCE TO RELATED APPLICATIONS

The present application claims priority to, and the benefit of, U.S. Provisional Application Ser. No. 61/974,644 entitled "STEERABLE HPM ANTENNA WITH CONICAL TRANS-REFLECTOR, FLAT TWIST-REFLECTOR, AND LEAKY-WAVE FEED," filed on Apr. 3, 2014, the disclosure of which is herein incorporated by reference in its entirety.

STATEMENT RE: FEDERALLY SPONSORED RESEARCH/DEVELOPMENT

Not Applicable

BACKGROUND

Technical Field

The present disclosure relates generally to antennas. More particularly, the present invention relates to steerable high-power microwave antennas.

Related Art

Electrical radiation antennas exist that broadcast a variety of low-powered signals in broad, narrow and directional beams. These low-power antennas use coaxial cable to transmit the energy from the radiation source to the antenna. In contrast, large, powerful radiation antennas have been used for radar and other operations but, when operated at power levels of 100 (MW) or above, their direction is frozen because of the need for heavy, rigid waveguides, maintained under high vacuum, to transmit the energy from the power source to the antenna.

It has been determined that a high-peak power microwave transmission, on the order of more than 100 megawatts of power, confined to a narrow pencil beam using an L-band antenna, lightweight (e.g., less than 250 kg) and compact enough to be deployed on a land vehicle or air platform, may find wide use in intercepting a target and degrading or neutralizing the electronic control monitoring systems and directional control systems in such targets as flying missiles and piloted aircraft as a means of rendering them ineffective without injuring human life. In other situations, civil authorities may find use for the device to neutralize the electrical system and computer-driven controls of an automobile or other motor vehicle thereby eliminating the need for extended car chase situations by police authorities that often result in destruction of property and severe injury or death to participants and members of the public.

BRIEF SUMMARY

According to an aspect of the present disclosure, a steerable, high-power microwave antenna is provided. The steerable, high-power microwave antenna includes: a forward-traveling, leaky-wave antenna; a trans-reflecting conical-sectional reflector disposed spaced-apart and above said leaky-wave antenna and having a conical surface facing said leaky-wave antenna and formed of a plurality of electrical conductors held in parallel order in a grill; and a twist-reflector pivotally mounted opposite and spaced-apart from said conical surface of said trans-reflecting conical-sectional reflector. The twist-reflector is adapted to receive microwave energy reflected to it from said conical surface of said trans-reflecting conical-sectional reflector and to rotate the polarization of said microwave energy and reflect said microwave energy back to said trans-reflecting conical-sectional reflector for passing through said trans-reflecting conical-sectional reflector and forming a narrow, pencil-like beam of high energy radiation in polarized form extending outward from said conical surface of said trans-reflecting conical-sectional reflector.

According to another aspect of the present disclosure, a compact, lightweight, steerable, high-power, microwave weapon is provided. The compact, lightweight, steerable, high-power, microwave weapon includes: a self-powered, microwave radiation source; a forward-traveling, leaky-wave antenna coupled to the microwave radiation source; a trans-reflecting conical-sectional reflector disposed spaced-apart and above said leaky-wave antenna and having a conical surface facing said leaky-wave antenna and formed of a plurality of electrical conductors held in parallel order in a grill; and a twist-reflector pivotally mounted opposite and spaced-apart from said conical surface of said trans-reflecting conical-sectional reflector. The twist-reflector is adapted to receive microwave energy reflected to it from said conical surface of said trans-reflecting conical-sectional reflector and to rotate the polarization of said microwave energy and reflect said microwave energy back to said trans-reflecting conical-sectional reflector for passing through said trans-reflecting conical-sectional reflector and forming a narrow, pencil-like beam of high energy radiation in polarized form extending outward from said conical surface of said trans-reflecting conical-sectional reflector.

In any one of the preceding aspects of the present disclosure, the leaky-wave antenna may be a flat-aperture waveguide sidewall-emitting antenna.

In any one of the preceding aspects of the present disclosure, the leaky-wave antenna may be a curved aperture waveguide sidewall-emitting antenna.

BRIEF DESCRIPTION OF THE DRAWINGS

Objects and features of the presently-disclosed steerable high-power microwave antennas will become apparent to those of ordinary skill in the art when descriptions of various embodiments thereof are read with reference to the accompanying drawings, of which.

DETAILED DESCRIPTION

Figure 1:
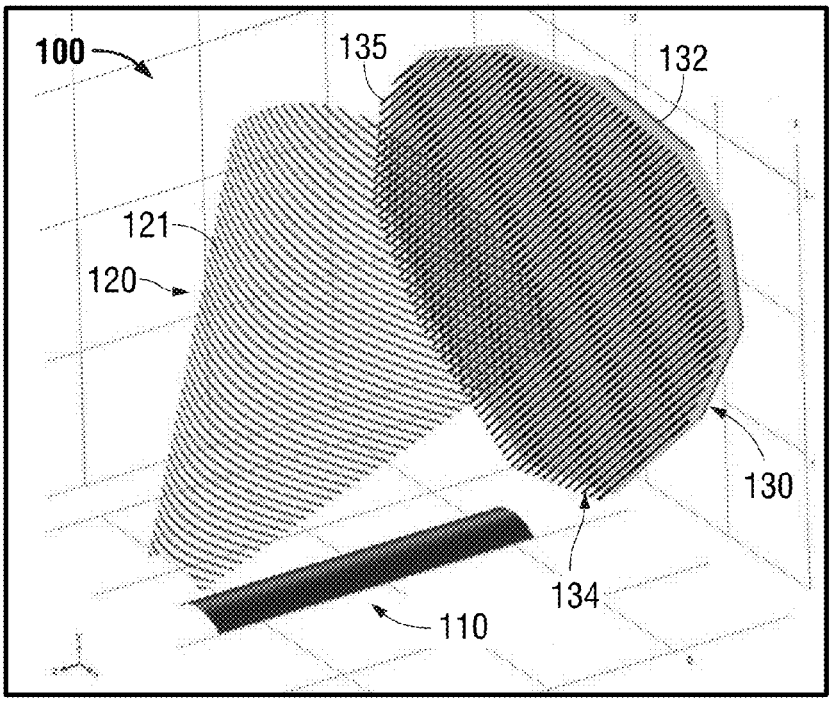
FIG. 1 is a schematic illustration of an antenna in accordance with an embodiment of the present disclosure.

Hereinafter, embodiments of a steerable, high-power microwave antenna are described with reference to the accompanying drawings. Like reference numerals may refer to similar or identical elements throughout the description of the figures.

This description may use the phrases "in an embodiment," "in embodiments," "in some embodiments," or "in other embodiments," which may each refer to one or more of the same or different embodiments in accordance with the present disclosure.

Electromagnetic energy is generally classified by increasing energy or decreasing wavelength into radio waves, microwaves, infrared, visible light, ultraviolet, X-rays and gamma-rays. As it is used in this description, "microwave" generally refers to electromagnetic waves in the frequency range of 300 megahertz (MHz) ($3\times10^8$ cycles/second) to 300 gigahertz (GHz) ($3\times10^{11}$ cycles/second). As it is used in this description, "transmission line" generally refers to any transmission medium that can be used for the propagation of signals from one point to another.

As it is used in this description, "length" may refer to electrical length or physical length. In general, electrical length is an expression of the length of a transmission medium in terms of the wavelength of a signal propagating within the medium. Electrical length is normally expressed in terms of wavelength, radians or degrees. For example, electrical length may be expressed as a multiple or sub-multiple of the wavelength of an electromagnetic wave or electrical signal propagating within a transmission medium. The electrical length may be expressed in radians or in other units of angular measure, such as degrees.

Conventional parabolic reflectors, including various axially-symmetric or offset parabolic-section configurations, are prevalent in highly-directional antennas, and include a parabolic surface having an associated focal point at which a lower-gain feed antenna is placed. The feed itself can be one of several kinds of antennas. Horns (e.g., pyramidal or conical horns) are common used, since horns generally offer fairly desirable properties for illuminating the main reflector and also typically have well-defined phase-centers. More complex geometries incorporating sub-reflectors are also common among point-focus reflector antenna configurations. Of these, the cassegrain configuration is well-known and incorporates a large parabolic primary reflector, a smaller convex hyperbolic secondary reflector, and a feed that illuminates the secondary through a hole in the primary reflector. Offset cassegrain dual-reflector configurations are also common. Gregorian dual-reflector configurations are similar, but make use of a concave secondary reflector. In these and comparable configurations, a large and doubly-curved (usually parabolic) primary reflecting surface is essential. But compared to flat or singly-curved surfaces, fabrication of large parabolic primary reflectors can be costly, especially for higher-gain configurations where mechanical tolerances must be maintained very tightly to achieve the desired performance.

High-power microwave antennas are essential technologies to microwave-based directed energy weapons (DEW). The term "high-power microwaves" as used within the DEW community has generally referred to peak power levels of 100 MW or more, and has become associated with gigawatts (GW), or even higher peak power levels. Under such conditions, most waveguides and many ordinary antennas left open to the atmosphere will suffer electrical breakdown, which reflects and blocks the transmission of the microwaves and is thus generally intolerable. To prevent such breakdown, waveguides must be either pressurized with breakdown-resistant gases (such as $SF_6$) or evacuated to high-vacuum conditions, the latter which yields the highest breakdown thresholds. Horn antennas connected to such evacuated waveguides are generally also evacuated, and usually sport thick windows on their apertures to withstand external pressure and provide resonant transmission. These apertures must be large enough to sufficiently distribute the power radiated such that it does not cause surface breakdown across the window exterior or bulk gas breakdown in the air around it. Feed aperture-area is thus a key limiting factor in regard to peak power-handling for conventional point-focus, parabolic reflector antenna designs. But large feed horns are cumbersome, heavy, difficult to position without causing aperture blockage, and can even yield overly-narrow illumination patterns when working with large reflectors, leading to undesirably-low reflector aperture efficiency.

Support for very high peak powers is possible by means of sufficiently large waveguide-fed apertures, without any reflectors. However, it is very cumbersome to achieve high gain without resorting to large reflectors.

To overcome the above-mentioned disadvantages and/or limitations, the presently-disclosed steerable, high-power microwave antennas overcome are adapted to operate at a significantly higher power, e.g., on the order of ten times the power attainable with previous designs, by using novel combinations of one or more trans-reflecting conical-sectional reflectors, one or more twist-reflectors, and a forward-traveling, leaky-wave antenna.

The conveyance of the input microwave power from one or more standard-size rectangular waveguides to a large aperture, in a low-profile package, is not practical with more conventional means such as a pyramidal horn. This is because serious phase-front distortion (phase error) and wave-reflection will occur if such a horn is made too short. In contrast to most alternative approaches for delivering such large apertures, a flat-aperture waveguide sidewall-emitting antenna (FAWSEA) possesses an unusually shallow depth especially advantageous for integration into fieldable military platforms. The FAWSEA is disclosed in U.S. Pat. No. 7,528,786 entitled "FLAT-APERTURE WAVEGUIDE SIDEWALL-EMITTING ANTENNA," the disclosure of which is herein incorporated by reference in its entirety. The FAWSEA is especially well suited to high-power microwave operation because of its relatively large aperture, which distributes the output power evenly over a large area, thus reducing the risk of microwave-induced air-breakdown or surface-breakdown that would otherwise impede proper operation and degrade output beam formation. The operating principles of the FAWSEA can be extended beyond the particular geometric realizations described in the above-mentioned U.S. Pat. No. 7,528,786. Reshaping of the FAWSEA into a curved aperture waveguide sidewall-emitting antenna (CAWSEA) makes it more suitable for use in cylindrical-like high-power microwave antennas, as explained in more detail herein.

A compact, lightweight, steerable, high-power, microwave weapon including a feed horn, a trans-reflector fixedly mounted and arranged spaced-apart and above the feed horn and having a concave surface facing the feed horn window and formed of a plurality of electrical conductors held in parallel order in a frame, and a twist-reflector pivotally mounted opposite and spaced-apart from the concave surface of the trans-reflector and adapted to receive microwave energy reflected to it from the concave surface of the trans-reflector and to rotate the polarization by 90° and reflect the microwave energy back to the trans-reflector for passing through the trans-reflector and forming a narrow, pencil-like beam of high-energy radiation in polarized form extending outward from the convex surface of the trans-reflector is disclosed in commonly-assigned U.S. Pat. No. 6,559,807 entitled "COMPACT, LIGHTWEIGHT, STEERABLE, HIGH-POWER MICROWAVE ANTENNA," the disclosure of which is herein incorporated by reference in its entirety.

Various embodiments of the present disclosure provide a steerable, high-power microwave (HPM) antenna. From a purely electromagnetic perspective, there are only three distinct components to the presently-disclosed HPM antennas: (1) a trans-reflecting conical-sectional reflector; (2) a flat, two-axis rotatable twist-reflector; and (3) a forward-traveling, leaky-wave antenna at the trans-reflector's focal-line. Embodiments of the presently-disclosed steerable, HPM antenna are adapted to produce a high energy beam that can be directed over a quadrant of azimuth and a quadrant of elevation without significant loss of power or directionality and without physically moving any component other than the highly-rotatable twist-reflector. The combined geometry delivers a high-gain steerable output beam and offers key advantages in terms of both manufacturability and peak power-handling, when compared to alternative antennas considered for use with HPM-based Directed Energy Weapons (DEW). Extremely-high peak power handling and rapid beam-steering are particularly important considerations in HPM-based DEW applications, and, as such, are the key motivating factors behind the present disclosure. The HPM antenna embodiments are described herein both in terms of components and as the full unit. Predicted performance characteristics that are described herein have been obtained via various analytic and numerical models.

FIGS. 1-4 show a steerable, HPM antenna 100 in accordance with an embodiment of the present disclosure. The steerable, HPM antenna 100 includes a trans-reflecting conical-sectional reflector 120, a twist-reflector 130, and a forward-traveling, leaky-wave antenna 110. The steerable, HPM antenna 100 (also referred to herein simply as "antenna 100") may include additional antenna components to secure the above-mentioned elements in place, to facilitate steering, and/or to facilitate storage and transportation.

The trans-reflecting conical-sectional reflector 120 is preferably made up of a plurality of parallel metal wire conductors 121. As the name "trans-reflector" suggests, the trans-reflecting conical-sectional reflector 120 reflects one polarization and transmits the other. The trans-reflecting conical-sectional reflector 120 (also referred to herein as an annular-sectional conical reflector) reflects horizontal but passes vertical polarization, and provides gain.

The trans-reflecting conical-sectional reflector 120 must be stiff enough to retain its shape during operation of the antenna 100. The trans-reflecting conical-sectional reflector 120 may include a suitable rigid material, e.g., polyurethane foam (or other material reasonably transparent to microwave energy), capable of providing support the wires 121 and/or providing the necessary stiffness. In an embodiment, a plurality of grooves, arranged in spaced-apart, mutually parallel alignment, is cut into the material using a machining or milling process, after which the wires 121 are positioned in the grooves. The wires 121 may be adhesively affixed or otherwise secured into place.

At the trans-reflecting conical-sectional reflector 120, the wave incident from the leaky-wave antenna 110 is polarized almost entirely horizontally (along the wires 121). This field cannot breakdown at the trans-reflecting conical-sectional reflector 120, because it is already "shorted out" by the wires 121. The trans-reflecting conical-sectional reflector 120 forms a high gain, but relatively wide-area beam of horizontally-polarized radiation that impinges on the twist-reflector 130.

The twist-reflector 130 includes a microwave reflecting surface 132 and a grill 134 located in front of the microwave reflecting surface 132. The grill 134 includes a plurality of electrical conductors 135 (e.g., metal wire conductors), which are slanted 45° compared to the wires 121 of the trans-reflecting conical-sectional reflector 120. The grill 134 and the microwave reflecting surface 132 are disposed in spaced-apart and parallel (or substantially parallel) relationship to each other. The twist-reflector 130 is a reflector that twists the polarization 90° in the process of reflecting it. For every angular degree of twist or rotation made in the twist-reflector 130, the azimuth and/or elevation of the microwave beam is changed by twice that angle. For instance, a 10° twist in the twist-reflector azimuth will produce a 20° change in the azmuthal direction of the beam.

Figure 2:
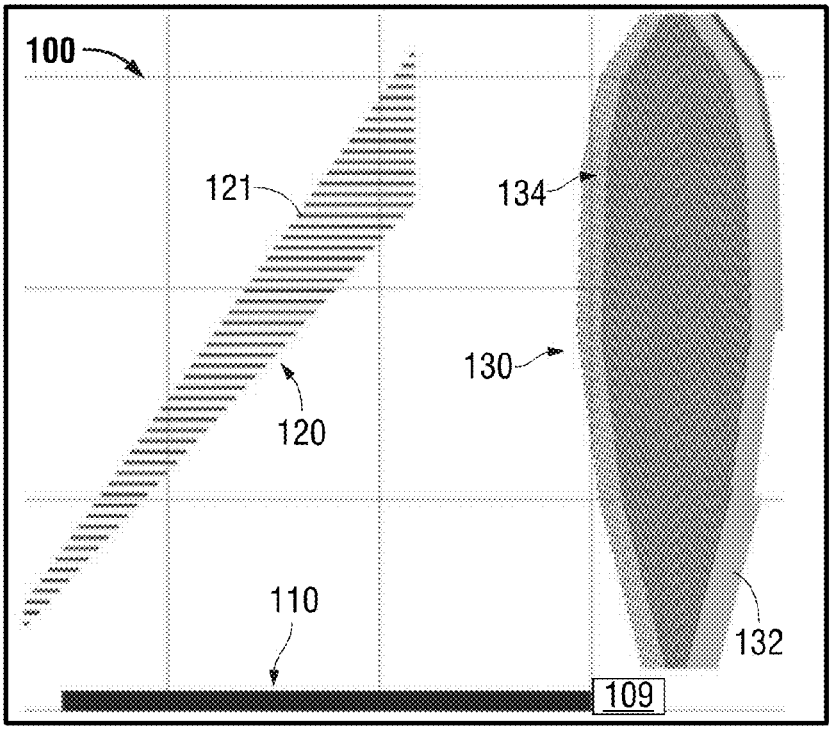
FIG. 2 is side view of the antenna of FIG. 1 in accordance with an embodiment of the present disclosure.
Figure 3:
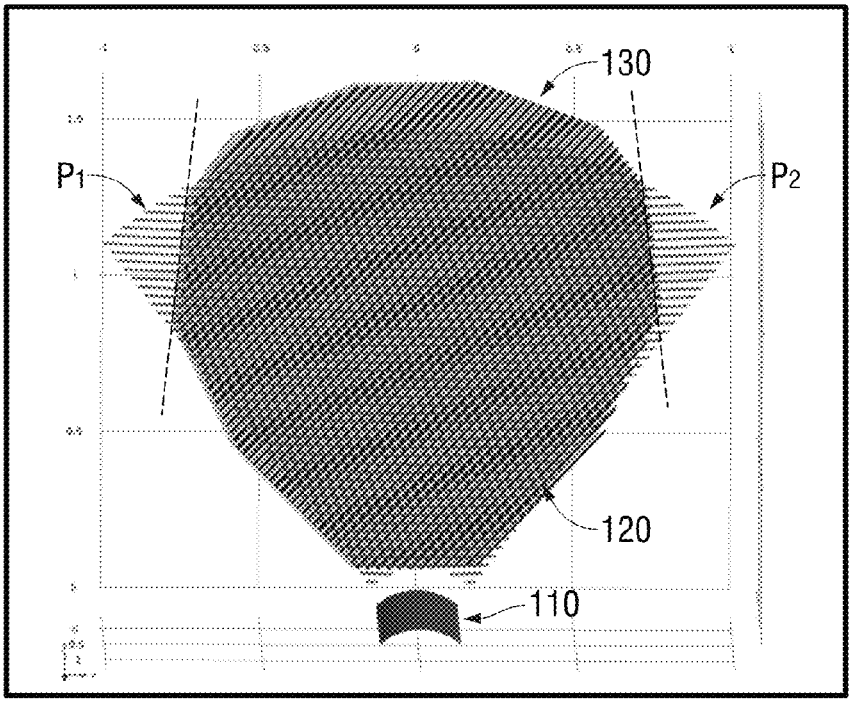
FIG. 3 is a front view of the antenna of FIG. 1 in accordance with an embodiment of the present disclosure.
Figure 4:
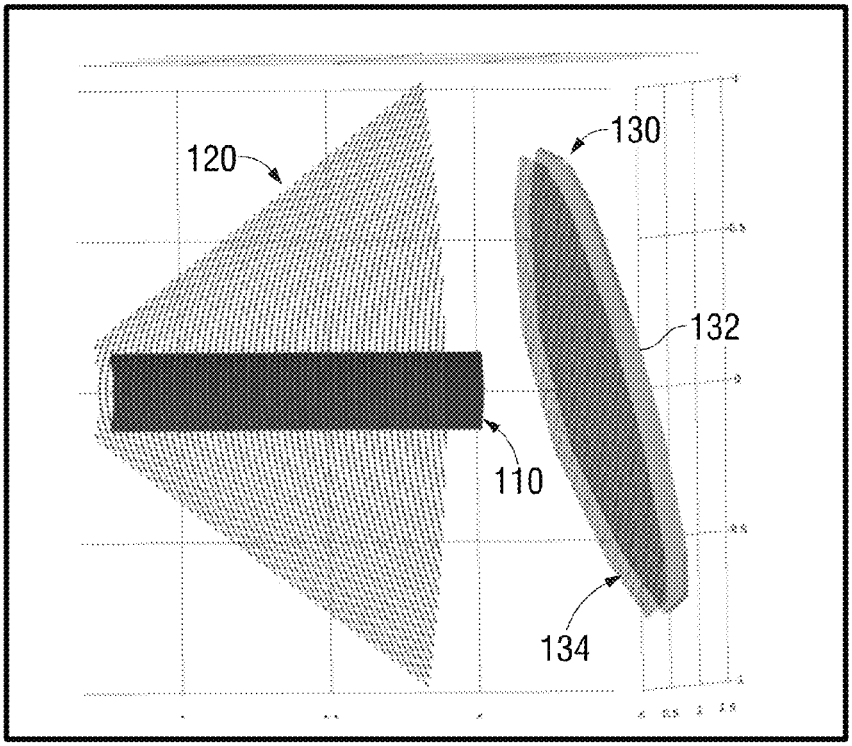
FIG. 4 is a top view of the antenna of FIG. 1 in accordance with an embodiment of the present disclosure.

As best seen in FIGS. 2 and 3, the twist-reflector 130 is disposed in spaced-apart relation to the trans-reflecting conical-sectional reflector 120. The twist-reflector 130 is arranged opposite and spaced-apart from the conical-sectional surface of the trans-reflecting conical-sectional reflector 120 for receiving the reflected energy from said conical-sectional surface, rotating its polarization by 90° and reflecting it backward toward the trans-reflecting conical-sectional reflector 120. That reflected energy, because it's polarization has been rotated 90° thereafter passes through the trans-reflecting conical-sectional reflector 120 and continues outbound from the convex surface thereof in the form of a high-power, narrow-angle beam of polarized microwave energy beam for intercepting a moving or stationary target and/or utilizing the microwave energy to neutralize electrical impulses and other electronic-based functions in the target. As illustratively depicted by the dashed lines in FIG. 3, portions $P_1$ and $P_2$ of the trans-reflecting conical-sectional reflector 120 may be removed in order to accommodate size requirements for the steerable, HPM antenna 100, e.g., depending upon particular requirements for storage and/or transportation. It is to be understood that the size, shape, and location of the portions $P_1$ and $P_2$ may be varied from the configuration depicted in FIG. 3.

The steerable, HPM antenna 100 combines a line-focus type feed with the trans-reflecting conical-sectional reflector 120. The flat aperture waveguide sidewall-emitting antenna (FAWSEA) has another incarnation, referred to as the curved-aperture waveguide sidewall-emitting antenna (CAWSEA), where the aperture is curved circumferentially around the line, and either one of these produces a beam that is reasonably suitable for illuminating the trans-reflecting conical-sectional reflector 120 which is made up of parallel wires 121.

The FAWSEA and CAWSEA provide: (1) support for gigawatt (GW)-level peak powers; (2) easy-configuration as a long, relatively-narrow aperture, and (3) aperture fields which can be distributed in both amplitude and phase fully-compatible with the line-focus feeding requirements of a conical reflector antenna.

As shown in FIG. 2, a self-powered, microwave radiation source 109 may be provided. The microwave radiation source 109 may include waveguide means to connect the power source 109 to the leaky-wave antenna 110. In some embodiments, the steerable, HPM antenna 100 and the self-powered, microwave radiation source 109 may be implemented as a compact, lightweight, steerable, high-power, microwave weapon.

Figure 5:
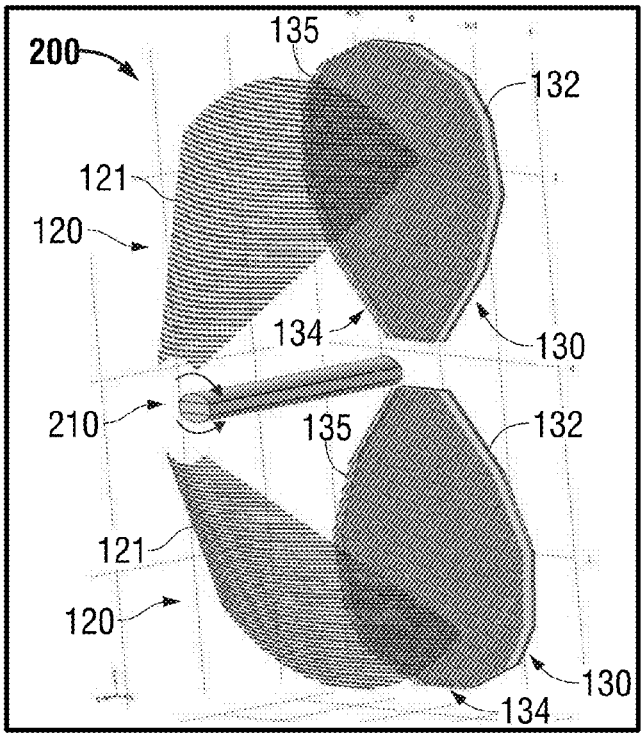
FIG. 5 is a schematic illustration of an antenna in accordance with another embodiment of the present disclosure.

FIG. 5 shows a steerable, HPM antenna 200 in accordance with an embodiment of the present disclosure. The steerable, HPM antenna 200 includes two trans-reflecting conical-sectional reflectors 120, two twist-reflectors 130, and a forward-traveling, leaky-wave antenna 210. The steerable, HPM antenna 200 (also referred to herein simply as "antenna 200") may include additional antenna components to secure the above-mentioned elements in place, to facilitate steering, and/or to facilitate storage and transportation. By introducing on the other side of the leaky-wave antenna 210 an arrangement that flips the fields over, larger gain can be attained. As seen in FIG. 5, the orientation of the grill 134 of the "lower" twist-reflector 130 is the same as the orientation of the grill 134 of the "upper" twist-reflector 130.

In FIG. 5, the blue arrows are not part of a circle going around the leaky-wave antenna 210, one of the arrows is reversed compared to the other. The feed shown in FIG. 5 is basically two antennas, e.g., either two FAWSEA antennas or two CAWSEA antennas. The CAWSEA is this one called curved, but it doesn't have to curve all the way around, it curves to some section, just like a piece of a cylinder if you're looking in on the feed. The leaky-wave antenna 210 that has two opposite faces with their electric fields (as indicated by the curved, blue arrows in FIG. 5) aligned as shown may be more difficult to build/implement in some cases, for example, as compared to the leaky-wave antenna 310 shown in FIG. 6. So, in the case where it is desirable to keep the feed as simple as possible, the arrangement in FIG. 6 may be preferable.

The twist-reflectors 130 of the steerable, HPM antenna 200 may be easier to manufacture because there would only need to be one part number, i.e., the first (e.g., upper) twist-reflector 130 is the same as the second (e.g., lower) twist-reflector 130, and thus it would not be necessary to designate and/or label the twist-reflectors 130 with different part numbers. In the case where it is desirable to have fewer different components, the arrangement in FIG. 5 may be preferable.

Figure 6:
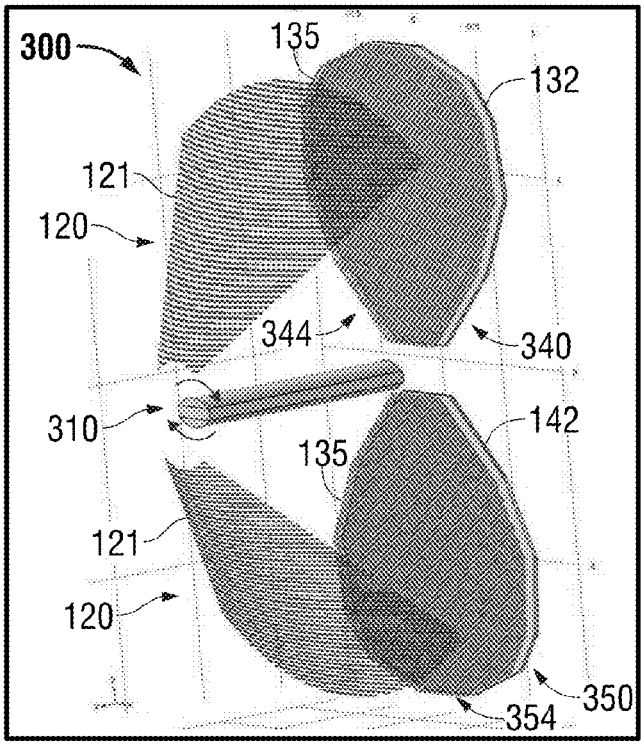
FIG. 6 is a schematic illustration of an antenna in accordance with yet another embodiment of the present disclosure.

FIG. 6 shows a steerable, HPM antenna 300 in accordance with an embodiment of the present disclosure. The steerable, HPM antenna 300 includes two trans-reflecting conical-sectional reflectors 120, a first twist-reflector 340, a second twist-reflector 350, and a forward-traveling, leaky-wave antenna 310. The leaky-wave antenna 310 that has two opposite faces with their electric fields (as indicated by the curved, blue arrows in FIG. 6) aligned as shown may be easier to build/implement than the leaky-wave antenna 210 shown in FIG. 6. The steerable, HPM antenna 300 (also referred to herein simply as "antenna 300") may include additional antenna components to secure the above-mentioned elements in place, to facilitate steering, and/or to facilitate storage and transportation.

The first twist-reflector 340 and the second grill 354 as shown in FIG. 6 each include the microwave reflecting surface 132 (also shown in FIGS. 1-4). The first twist-reflector 340 includes a first grill 344, and the second twist-reflector 350 includes a second grill 354, wherein the arrangement of the wires 135 of the first grill 344 is a minor image of the arrangement of the wires of second grill 354. As seen in FIG. 6, the orientation of the grill 354 of the second twist-reflector 350 is the perpendicular to the orientation of the grill 344 of the first twist-reflector 340. In other words, the first twist-reflector 340 is a minor image of the second twist-reflector 350 (i.e., not a rotation)—so those are two different twist-reflectors in this variation. And that particular arrangement is very convenient for feeding with one of the FAWSEA or CAWSEA antennas. And which offers the advantage of handling very high power, because the power is distributed along that line (e.g., rather than the point like arrangement which is approximated by a pyramidal horn described in other antennas).

Conical Reflectors Illuminated by Traveling-Wave Line-Source Feeds

Figure 7:
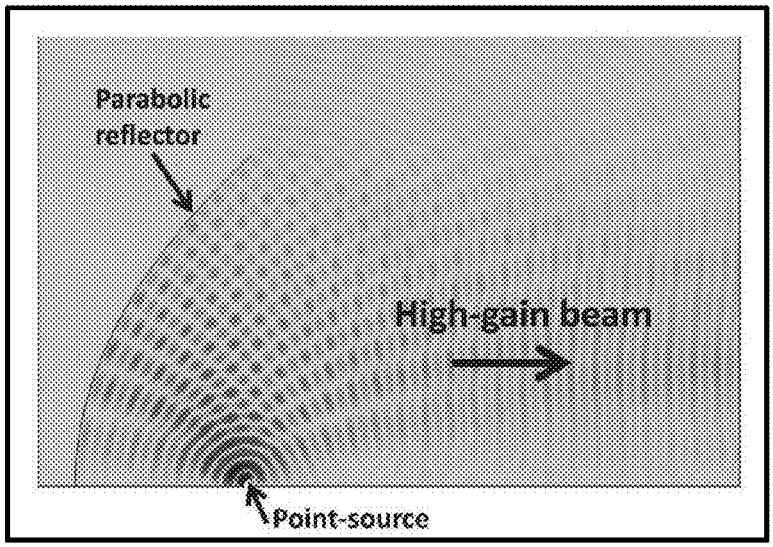
FIG. 7 illustrates a model of a parabolic reflector with a point-source feed.
Figure 8:
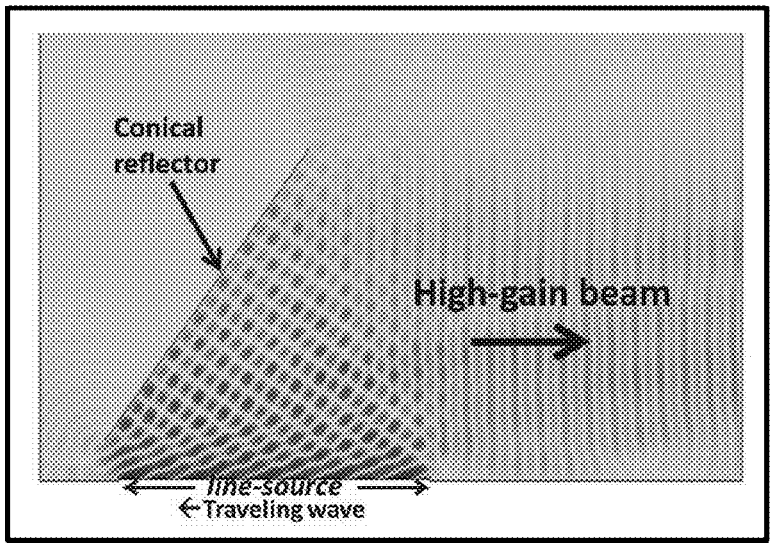
FIG. 8 illustrates a model of a conical reflector with a line-source feed carrying a leftward-traveling wave in accordance with an embodiment of the present disclosure.
Figure 9:
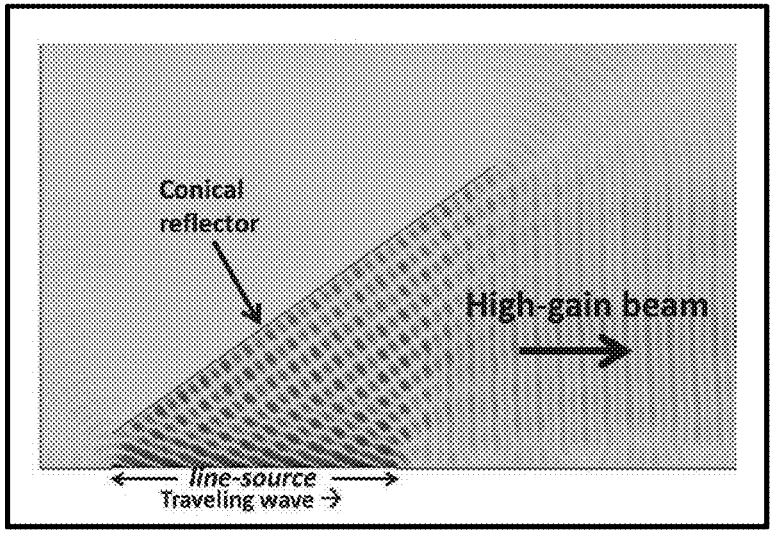
FIG. 9 illustrates a model of a conical reflector with a line-source feed carrying a rightward-traveling wave in accordance with an embodiment of the present disclosure.

FIGS. 7-9 compare results of 2D-axisymmetric finite-element RF numerical models illustrating the operation of a conventional parabolic reflector with a point-source feed and a conical reflector with a line-source feed, the latter with a phase distribution corresponding to either leftward-traveling or rightward-traveling waves. The illustrated configurations all yield high-gain output beams. In practice, leaky traveling-wave line-sources such as in FIGS. 7-9 can be realized with a FAWSEA, providing peak-power handling superior to that achievable with point-like sources (such as a horn), such as would be required to feed a similarly-sized parabolic reflector.

Preliminary Layout of Feed and Conical Reflector (Based on Geometric Optics)

Figure 10:
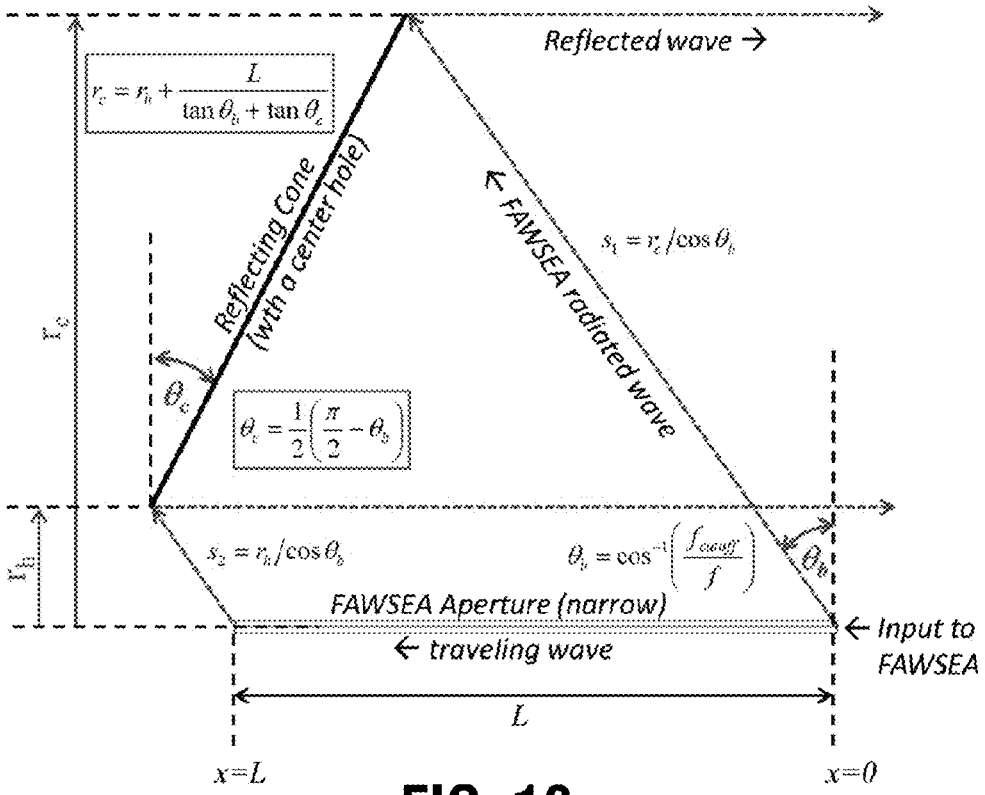
FIG. 10 illustrates a flat aperture waveguide sidewall-emitting antenna (FAWSEA)-fed conical reflector, based on geometric optics in accordance with an embodiment of the present disclosure.

FIG. 10 shows some useful quantities and relationships that follow from geometric optics considerations, for a FAWSEA-fed conical (or sectional conical) reflector with a center hole. Note especially the relationships between the feed beam angle $\theta_b$ and the reflecting cone angle $\Theta_c$, which follow from imposing the constraint that a reflected wave generated is parallel to the horizontal axis. Ideally, to compensate for unbalanced space-loss (i.e., $s_1>s_2$ in FIG. 10), the feed aperture power-leakage rate should be adjusted (e.g., via its leaky-grill wire diameters or wire-separations) so that the illumination (power per area) upon the reflector at any value of r (with $r_h<r<r_c$) is the same. The power per length emitted from the feed at any position x (see FIG. 10) may be denoted as $\dot{P}(x)$, and the slant distance (along the feed-radiated wave k vector) as $s(x)=r/\cos\theta_b$, to any point at a cylindrical radius r on the reflecting cone. The area of any thin circular (or circular segment) ring on the cone is proportional to r. For a leaky-wave feed in the geometric optics approximation, delivering equal power densities to all points r on the reflector implies $\dot{P}(x)/s(x)$=a constant, but since s is proportional to r, it can be written that $\dot{P}(x)/r$=a constant, where r is taken as the radius on the reflector that is illuminated by the ray coming from the feed location x.

Figure 11:
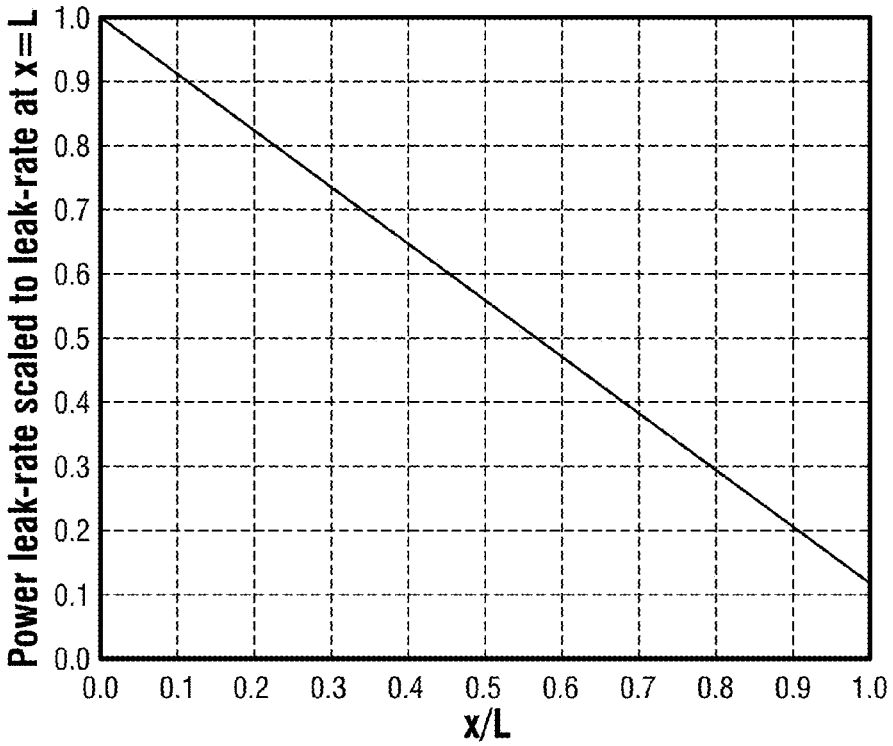
FIG. 11 is a graph illustrating a preferred feed leakage rate in accordance with an embodiment of the present disclosure.
Figure 12:
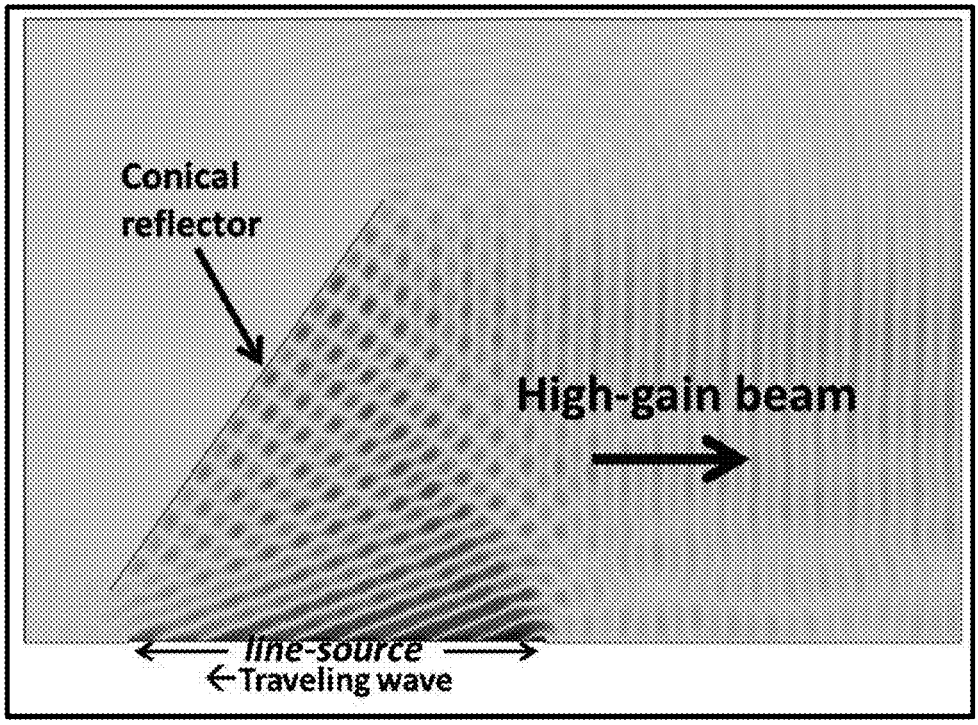
FIG. 12 illustrates a two-dimensional (2D) axisymmetric model of a conical reflector with tapered leak rate in accordance with an embodiment of the present disclosure.
Figure 13:
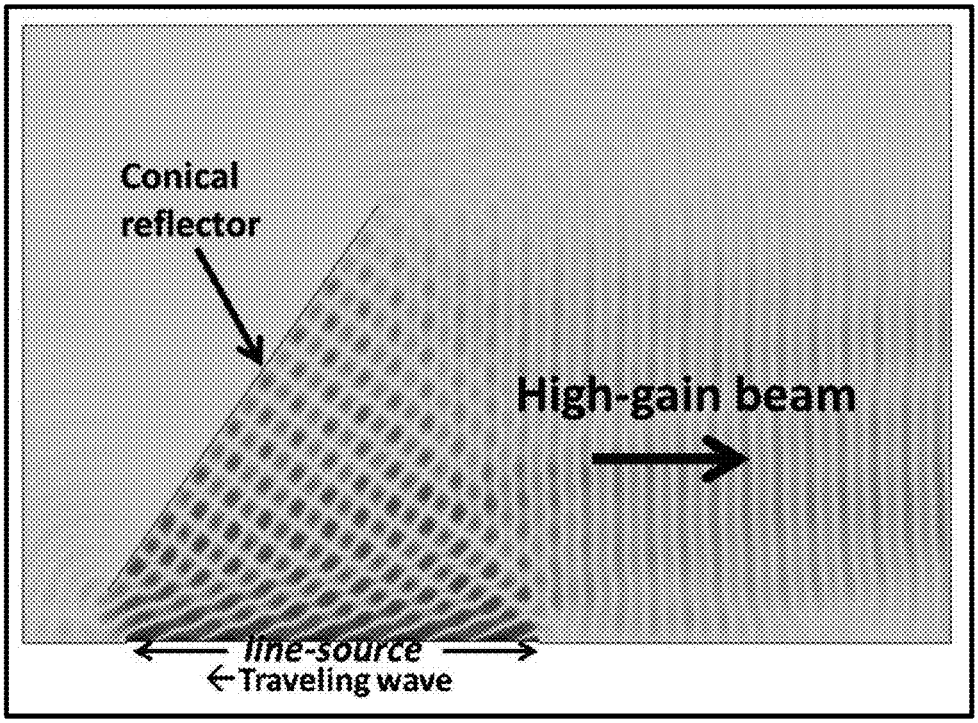
FIG. 13 illustrates a 2D axisymmetric model of a conical reflector with constant leak rate in accordance with an embodiment of the present disclosure.

By a little trigonometry, it can be shown that $L-x=(r-r_h)(\tan\theta_b+\tan\sigma_c)$, or $r=r_h+(L-x)/(\tan\theta_b+\tan\theta_c)$. Thus, it can be written:

$$\frac{\dot{P}_{leak}(x)}{\dot{P}_{leak}(L)} = \frac{r}{r_h} = 1 + \frac{(L-x)}{r_h(\tan\theta_b + \tan\theta_c)}$$

as the preferred feed leakage rate, with the caveat that it is based on a geometric optics approximation. (This contrasts with the constant leakage rate that is appropriate if attempting to optimize the gain of a leaky-wave aperture alone.) As an example, suppose $\theta_b$=20° (and thus Θ=35°), L=2 m, and $r_h$=0.25 m: we plot $\dot{P}(x)/\dot{P}(L)$ versus x in FIG. 11. A comparison of 2D axisymmetric numerical models of that geometry, comparing the behavior with the aforementioned tapered feed leak-rate versus a constant leak-rate, is shown in FIGS. 12 and 13. There are differences, but the effects are not dramatic and it is not even clear if the particular tapering employed has yielded a net benefit. To understand why the above view is insufficient to optimize the design, a three-dimensional view is required. This makes it possible to more properly account for: (1) the azimuthally-oriented (versus unidirectional) fields from the feed; and (2) diffraction at reflector and feed aperture boundaries.

Understanding Annular-Sectional Conical Reflectors

Figure 14:
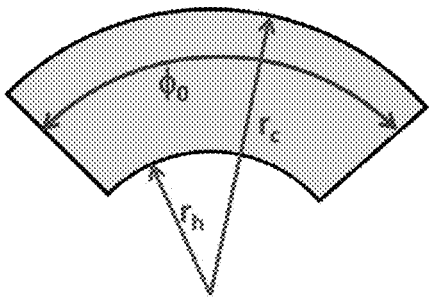
FIG. 14 illustrates the geometry and aperture area of an annular-sectional conical reflector (on-axis projection) in accordance with an embodiment of the present disclosure.
Figure 19:
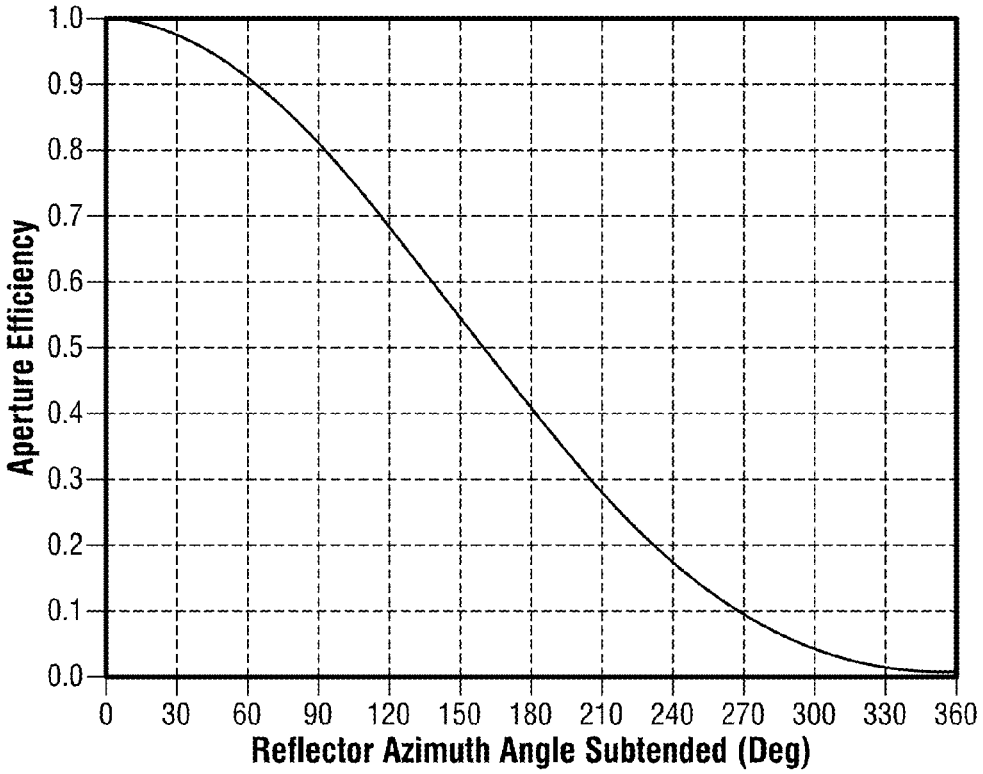
FIG. 19 is a plot of the upper-bound to the aperture efficiency versus subtended azimuthal angle in accordance with an embodiment of the present disclosure.

FIG. 14 shows a face-on projection of an annular-section conical reflector. $\phi_0$ looks to be about 90° in FIG. 14. If it went all the way around, it would not be good because the electric field from one side would cancel the field from the other when looking it on axis—resulting in a null on the axis which is what leads to that zero aperture efficiency curve (0 at 360°) in FIG. 19.

Figure 15:
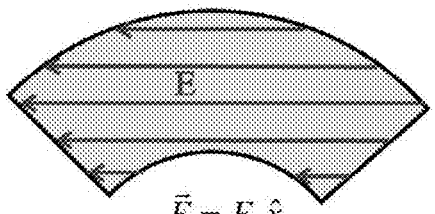
FIG. 15 illustrates the geometry, aperture illumination pattern, and analytically-predicted on-axis gain of an annular-sectional conical reflector (uniform electric field) in accordance with an embodiment of the present disclosure.
Figure 16:
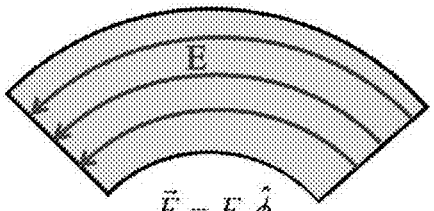
FIG. 16 illustrates the geometry, aperture illumination pattern, and analytically-predicted on-axis gain of an annular-sectional conical reflector (line feed, idealized) in accordance with an embodiment of the present disclosure.

Aperture efficiency matters because it relates to how well the antenna is projecting power in the desired straight forward beam compared to if it had an ideal illumination such as shown in FIG. 15. The ideal field distribution upon the aperture's projection, with an objective of optimizing gain, is both uniform and unidirectional, as shown in FIG. 15. However, a narrow line source will produce illumination more like that in FIG. 16. This reduces the aperture efficiency (see FIG. 19).

In the preferred embodiment, $\phi_0$ is limited to less than about 90-120° for line-fed annular-section conical reflectors, since extending to wider azimuthal angles will begin to seriously erode the aperture efficiency, i.e., destructive interference is produced along the axis for those portions of the aperture where the orientation of E seriously departs from those in the other portions. In the case of a full-azimuth cone (i.e., $\phi_0$=360°), destructive interference becomes complete; the on-axis gain falls to zero (see also FIG. 19).

Designs Leveraging 3D Full-Wave RF Numerical Models

Figure 17:
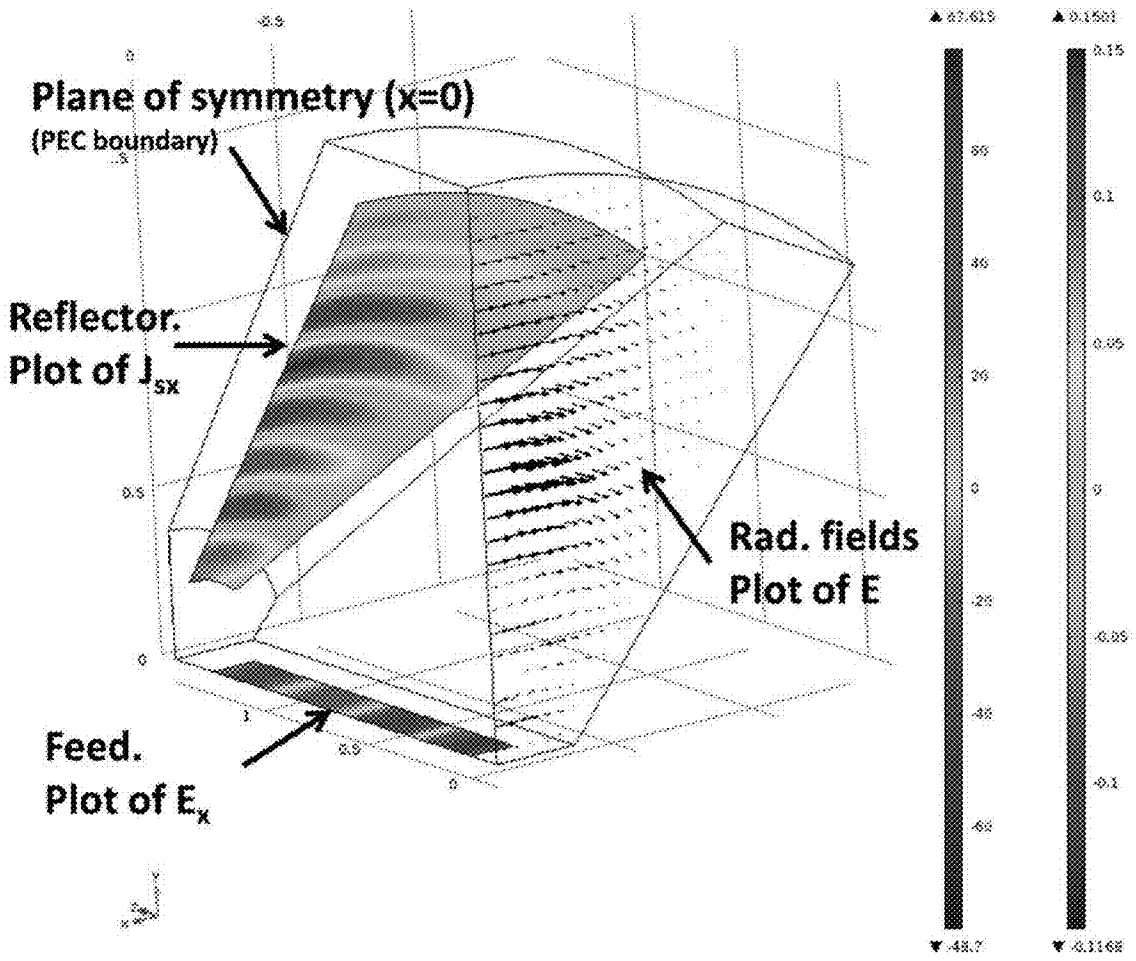
FIG. 17 illustrates a three-dimensional (3D) radio frequency (RF) model of a solid, annular-sectional conical reflector driven by an analytically-specified traveling-wave leaky-wave feed with a finite width in accordance with an embodiment of the present disclosure.
Figure 18:
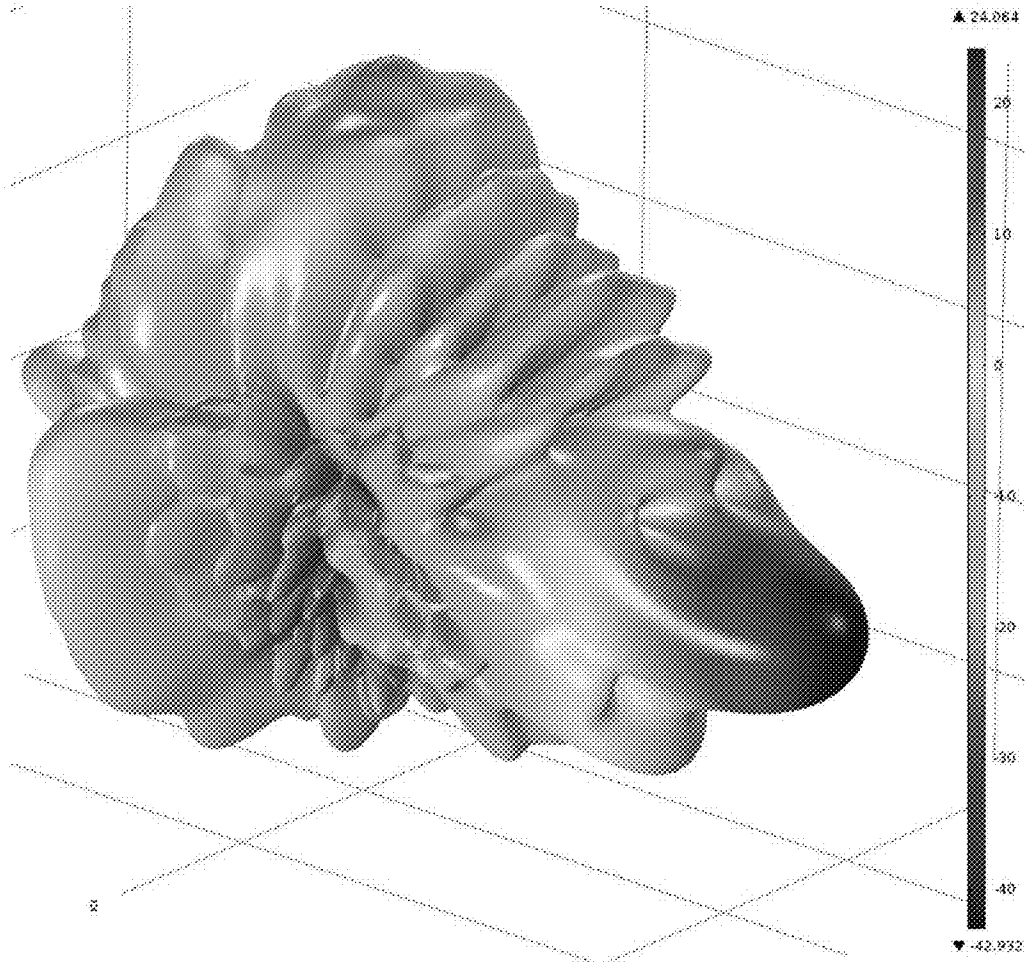
FIG. 18 illustrates a predicted 3D gain pattern of the solid, annular-sectional conical reflector of FIG. 17 driven by an analytically-specified traveling-wave leaky-wave feed with a finite width in accordance with an embodiment of the present disclosure.

FIG. 17 provides an example of a fully-3D RF model with an analytically-specified leaky-wave feed with a finite width. This numerical model considers the feed and reflector combination cut in half along a left-right symmetry plane, but with the computed results representative of the full antenna (i.e., if both halves were present). The predicted 3D pattern and some relevant beam parameters are noted in FIG. 18.

Figure 20:
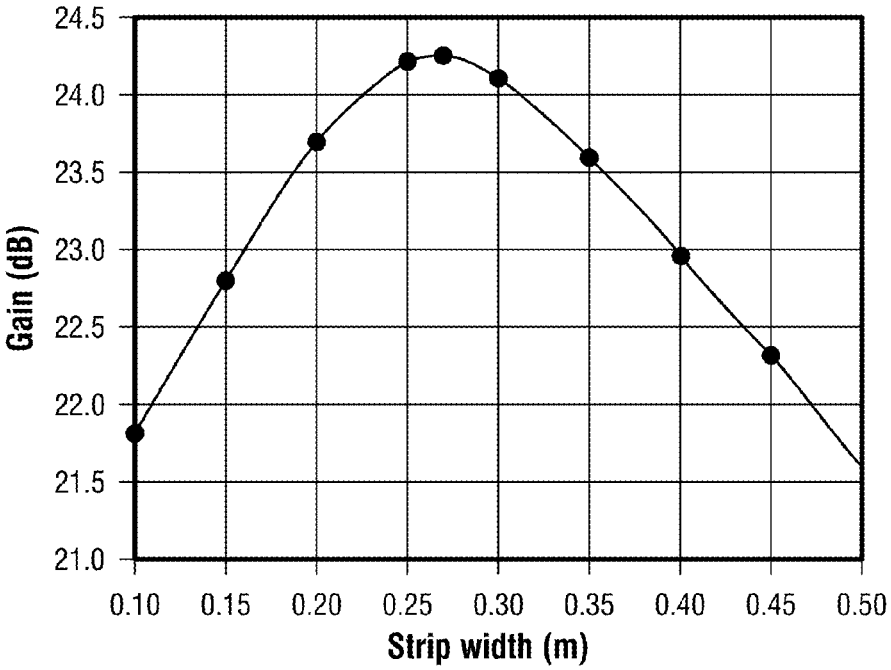
FIG. 20 is a plot of the predicted gain versus feed strip width for the antenna of FIG. 17 in accordance with an embodiment of the present disclosure.

The width of the leaky-wave feed strip makes a difference, since it controls how wide the feed's local radiated beam will be in the E-plane. And of course, the uniformity of the feed's beam in illuminating the conical reflector impacts the gain achieved there. FIG. 20 shows the dependence upon the feed strip-width of the gain produced by the conical reflector, as computed via 3D finite-element full-wave RF models. The specific example in FIG. 17 and FIG. 18 used a feed width of 0.3 m, but more complete study shows that a feed width of 0.27 m is a better choice, since it yields a predicted reflector gain of 24.257 dB, and thus an improved aperture efficiency=$10^{(2.4257-2.5964)}$=67.5%.

Development of a Trans-Reflector/Twist-Reflector Steerable Configuration

As with point-fed parabolic reflectors, a line-fed conical reflector can be extended to form a steerable beam system by replacing the solid reflecting surface (in this case, the conical reflector) with a surface comprised of parallel strips and/or wires. Such a surface acts as a polarizer, reflecting fields with polarization parallel to the strips and transmitting those with polarization perpendicular to the strips. When such a surface executes both such actions with little or no wave-absorption in the process, it is known as a trans-reflector. This can then be paired with an opposing twist-reflector, which is a composite surface that when oriented appropriately, yields a reflected wave with a 90° rotation relative to the incident wave. This rotated-polarization can then pass through the trans-reflector. Most importantly, the twist-reflector can be tilted to steer the output beam, without any need to move or reorient the feed or trans-reflector. This is an especially-valuable feature in an HPM DEW antenna.

Figure 21:
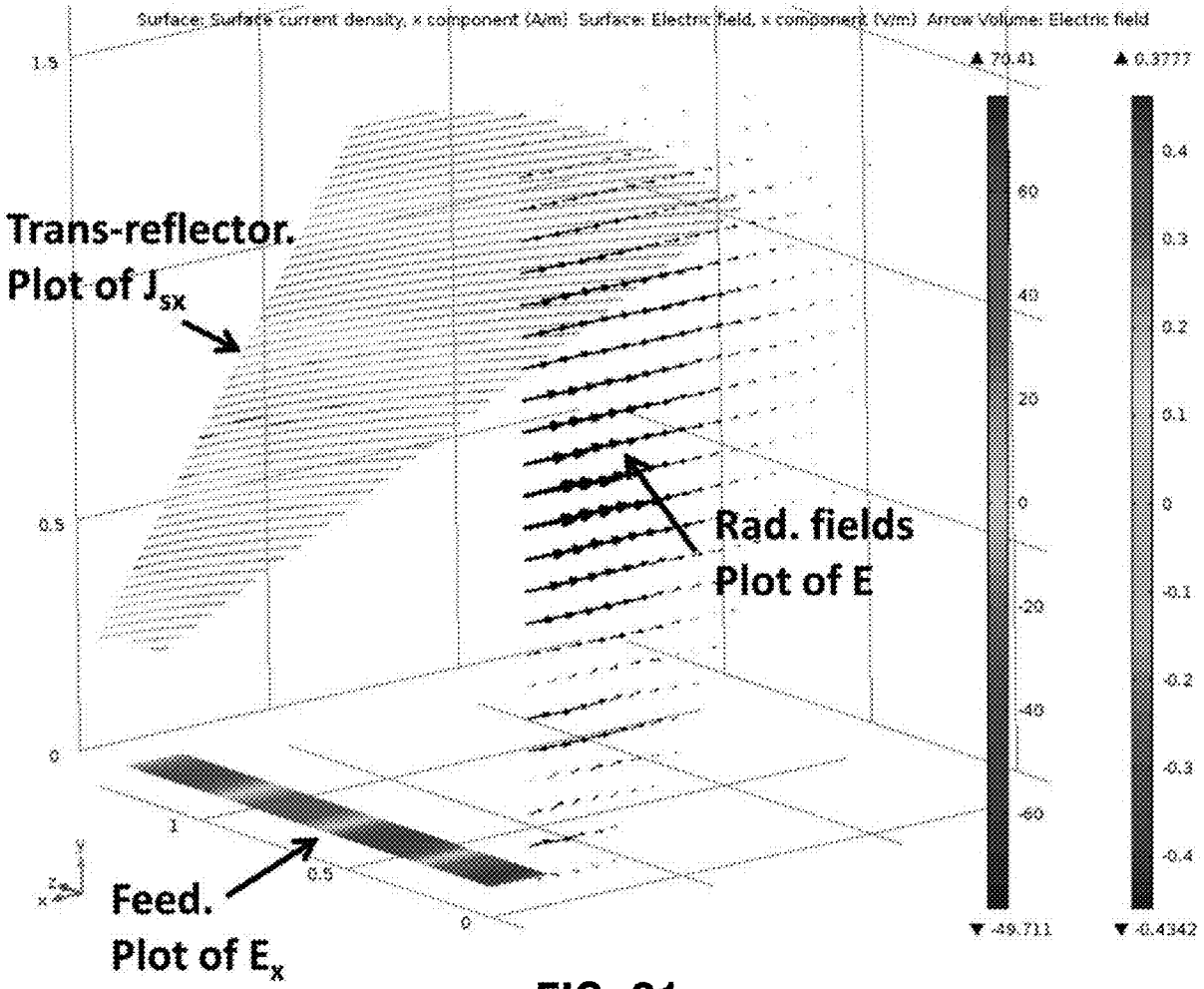
FIG. 21 illustrates a 3D numerical model of an antenna geometry, showing the solid, annular-sectional conical reflector of FIG. 17 perforated to form a set of conducting strips, parallel to the x-axis, in accordance with an embodiment of the present disclosure.
Figure 22:
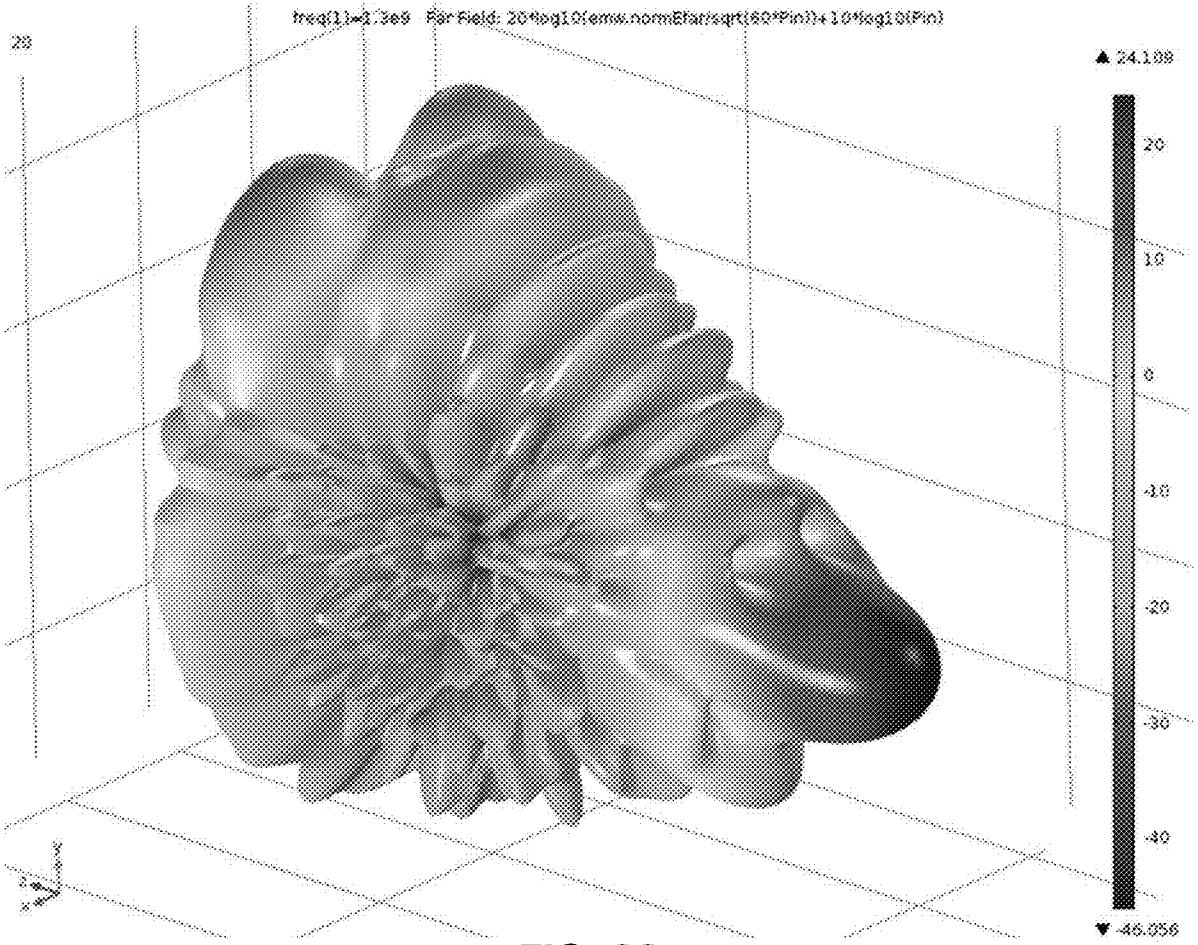
FIG. 22 illustrates a predicted 3D gain pattern of a trans-reflecting, annular-sectional conical reflector driven by an analytically-specified traveling-wave leaky-wave feed with a finite width in accordance with an embodiment of the present disclosure.

FIG. 21 shows a 3D numerical model of an antenna geometry like that in FIG. 17, but where the previously-solid conical reflector has been perforated to form a set of conducting strips, parallel to the x-axis. Note: Plotting of the finite-element model volume edges is suppressed, to allow the currents on the trans-reflector strips to be better viewed. The plane of symmetry used in FIG. 17 also applies here. One observable difference is that the radiated fields from the conical trans-reflector are more cleanly-oriented along the x-axis. This is because the small component of E from the feed that is perpendicular to the trans-reflector strips has passed through the trans-reflector and been lost. For modest subtended angles $\phi_0$ (see FIGS. 14-16 and FIG. 19), this lost power should be tolerable. Predicted beam characteristics and performance are summarized in FIG. 22.

Both the gain and major lobes are very similar to solid-reflector case. The main-beam beam-widths are actually narrower however, due to the more uniform polarization of the radiated field parallel to x, as noted earlier. But this does not translate into higher gain on-axis due to the power leaked through the trans-reflector, as noted earlier.

Figure 23:
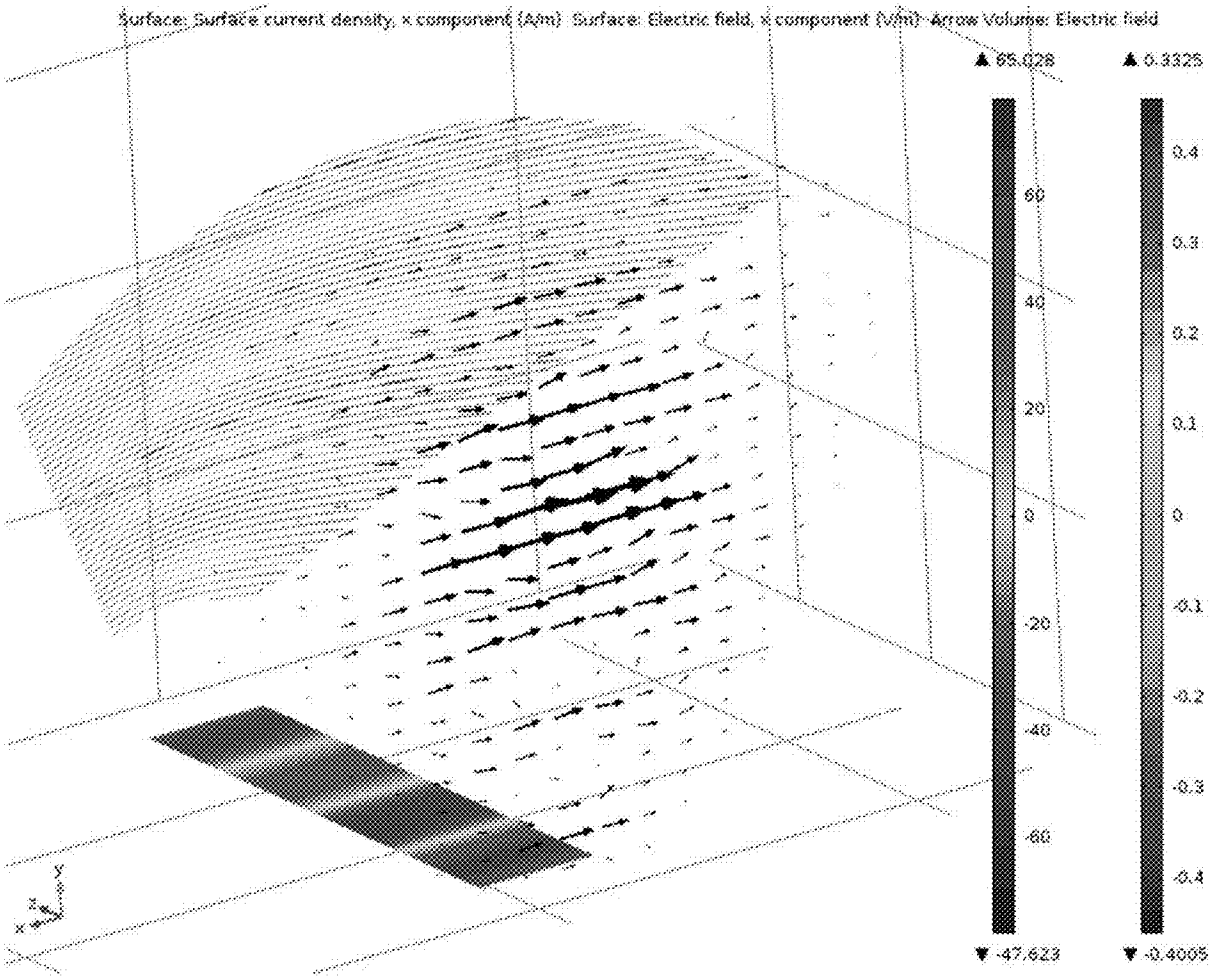
FIG. 23 is confirmation of behavior in a full-width numerical model, prepared in anticipation of adding a twist-reflector in accordance with an embodiment of the present disclosure.

FIG. 23 displays a full-width simulation (more computationally intensive) of the same antenna as in FIG. 21. This is a necessary step in advance of including a twist-reflector in the model. The twist-reflector violates the earlier left-right symmetry.

Figure 24:
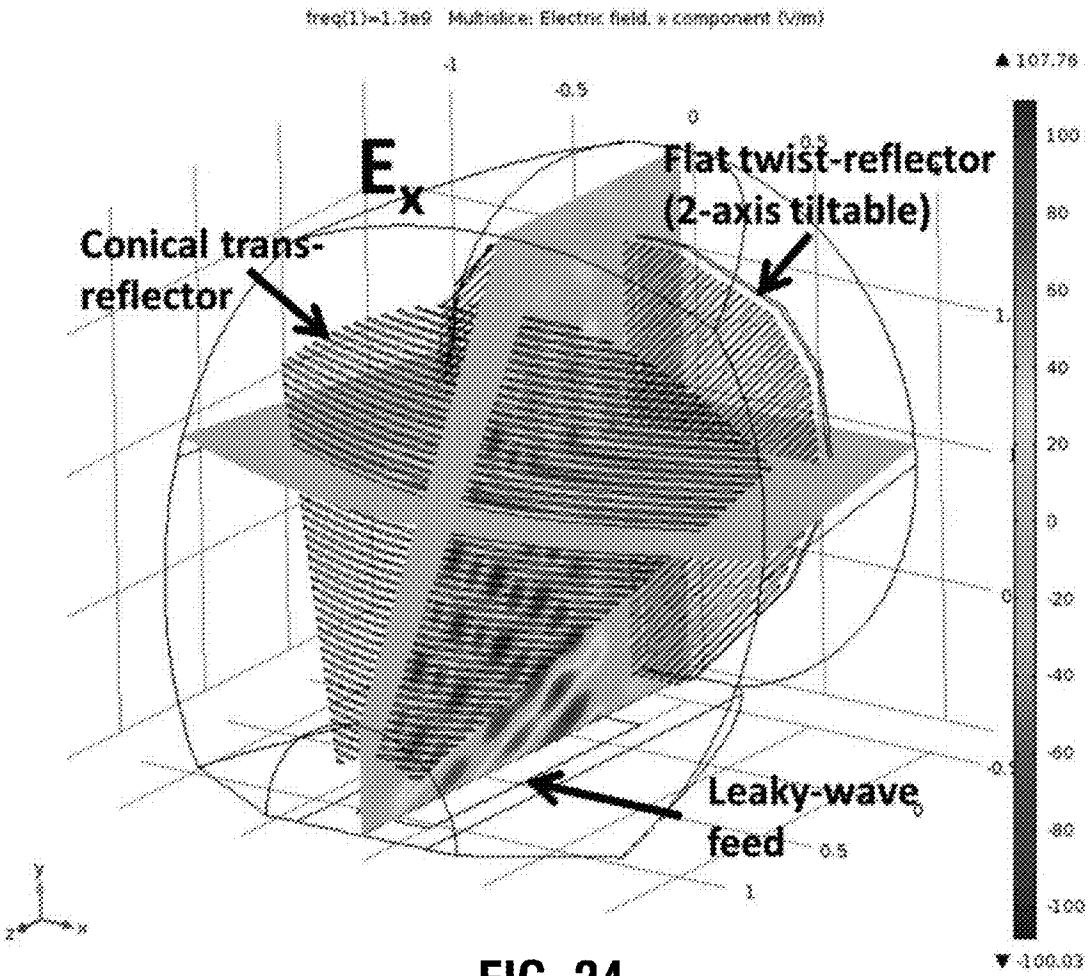
FIG. 24 illustrates a numerical model of a conical trans-reflector, flat twist-reflector, and analytically-specified leaky-wave flat feed, with plots of $E_x$ in two cut planes, in accordance with an embodiment of the present disclosure.

FIG. 24 shows a snapshot of slices of $E_x$ in a full 3D model that combines the annular sectional conical trans-reflector, flat twist-reflector, and analytically-specified leaky-wave flat feed.

Figure 25:
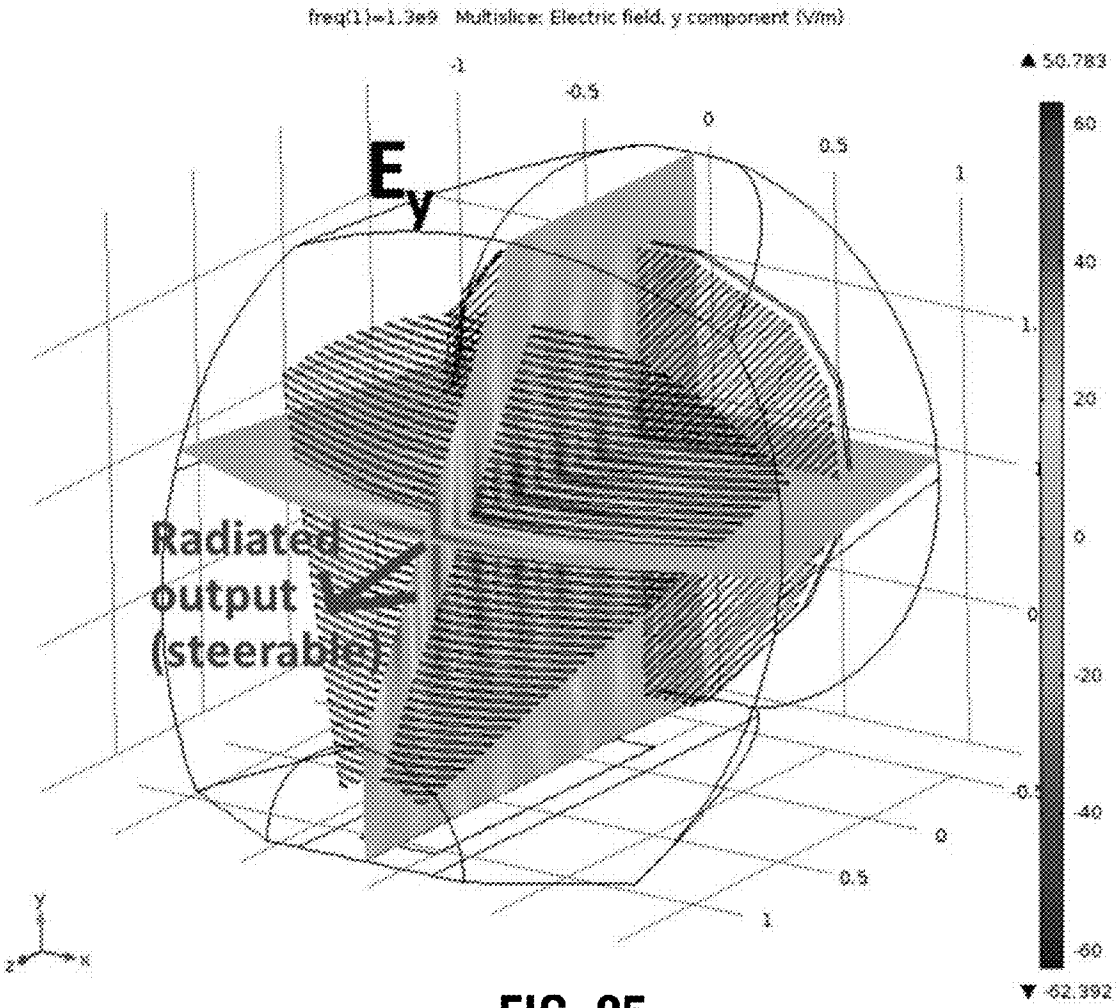
FIG. 25 illustrates a numerical model of the conical trans-reflector, flat twist-reflector, and analytically-specified leaky-wave flat feed of FIG. 24, with plots of $E_y$ in two cut planes, in accordance with an embodiment of the present disclosure.

FIG. 25 shows a snapshot of slices of $E_y$ in a full 3D model that combines the annular sectional conical trans-reflector, flat twist-reflector, and analytically-specified leaky-wave flat feed.

Figure 26:
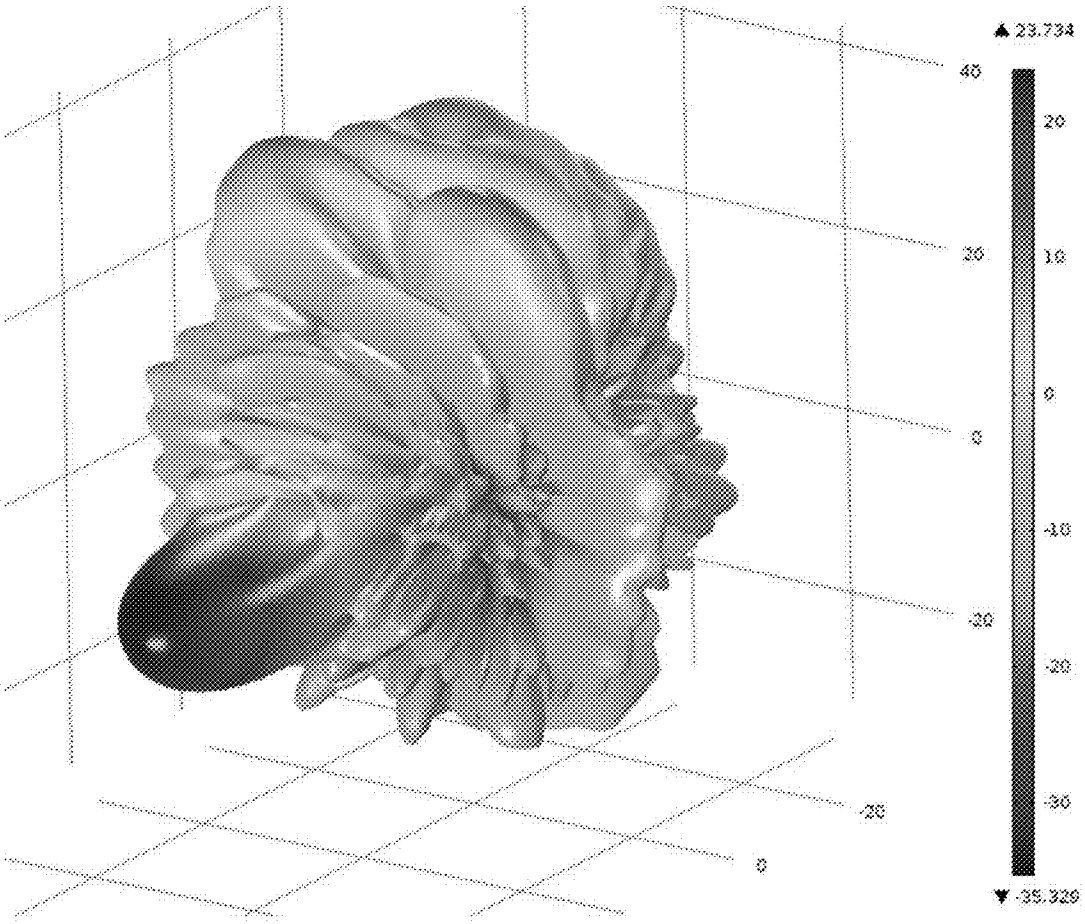
FIG. 26 illustrates a predicted 3D gain pattern of the antenna of FIG. 25 in accordance with an embodiment of the present disclosure.

FIG. 26 shows the predicted gain pattern of this antenna at f=1.3 GHz. Note how the addition of the twist-reflector reduced the gain by only about 0.4 dB overall, while providing steer-ability to the system, as illustrated in FIGS. 27-29.

Figure 27:
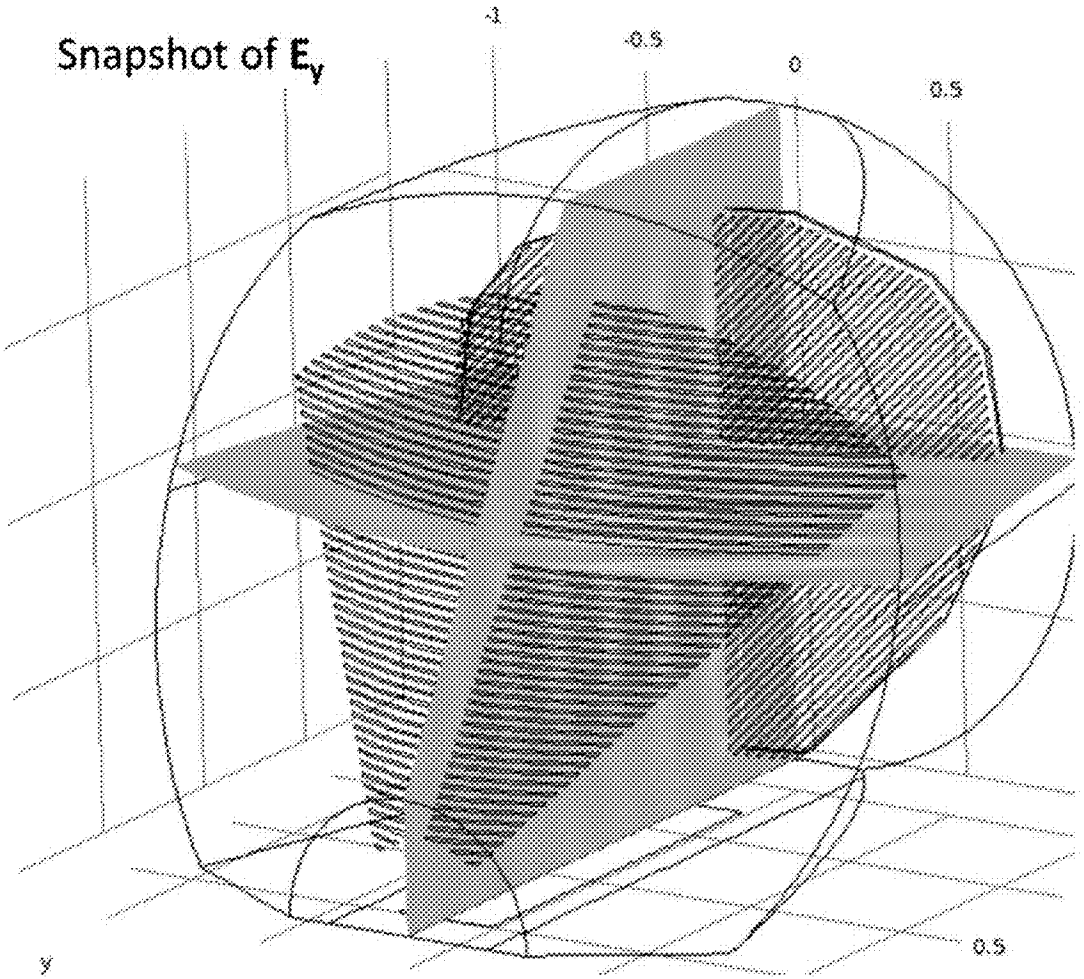
FIG. 27 illustrates a numerical model of a conical trans-reflector, flat twist-reflector, and analytically-specified leaky-wave flat feed, after steering the twist-reflector by 15°, with azimuth plots of $E_y$ in two cut planes, in accordance with an embodiment of the present disclosure.
Figure 28:
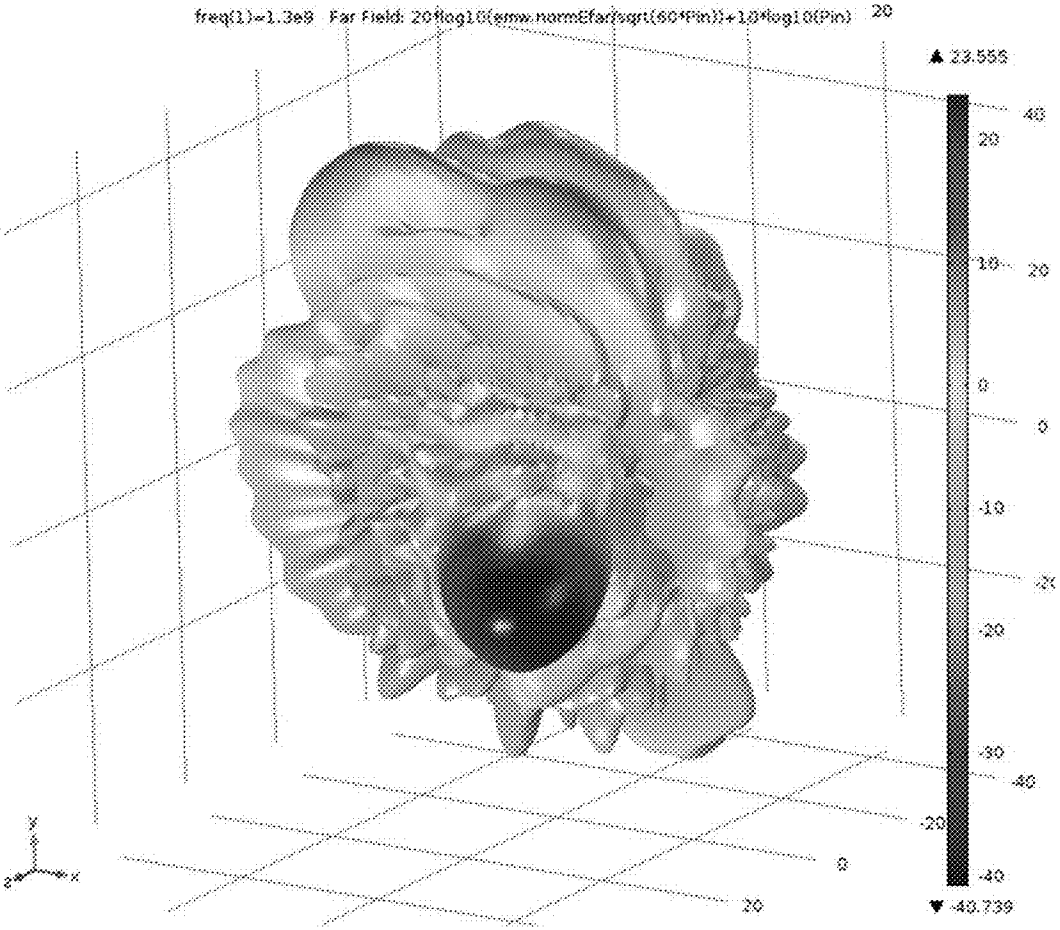
FIG. 28 illustrates a predicted 3D gain pattern of the antenna of FIG. 27 in accordance with an embodiment of the present disclosure.
Figure 29:
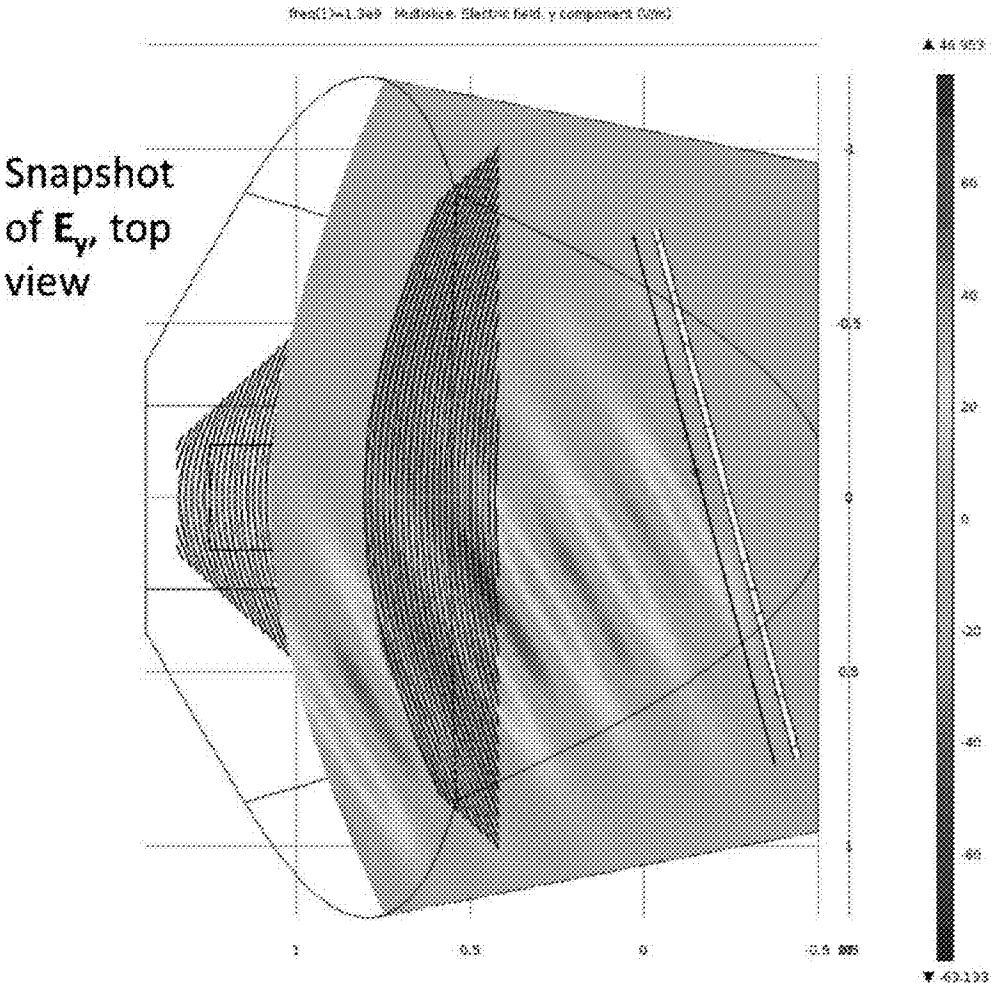
FIG. 29 is a top view of the antenna of FIG. 27 in accordance with an embodiment of the present disclosure.

FIGS. 27 and 29 show snapshots of slices of $E_y$ in a full 3D model that combines the leaky-wave feed, the annular sectional conical trans-reflector, and a flat twist-reflector.

Although embodiments have been described in detail with reference to the accompanying drawings for the purpose of illustration and description, it is to be understood that the disclosed processes and apparatus are not to be construed as limited thereby. It will be apparent to those of ordinary skill in the art that various modifications to the foregoing embodiments may be made without departing from the scope of the disclosure.

What is claimed is:

1. A steerable, high-power microwave antenna, comprising:

a forward-traveling, leaky-wave antenna;

a trans-reflecting conical-sectional reflector disposed spaced-apart and above said leaky-wave feed antenna and having a conical surface facing said leaky-wave feed antenna and formed of a plurality of electrical conductors held in parallel order in a grill; and a twist-reflector pivotally mounted opposite and spaced-apart from said conical surface of said trans-reflecting conical-sectional reflector and adapted to receive microwave energy reflected to it from said conical surface of said trans-reflecting conical-sectional reflector and to rotate the polarization of said microwave energy and reflect said microwave energy back to said trans-reflecting conical-sectional reflector for passing through said trans-reflecting conical-sectional reflector and forming a narrow, pencil-like beam of high energy radiation in polarized form extending outward from said conical surface of said trans-reflecting conical-sectional reflector.

2. The steerable, high-power microwave antenna of claim 1, wherein the leaky-wave antenna is a flat-aperture waveguide sidewall-emitting antenna.

3. The steerable, high-power microwave antenna of claim 1, wherein the leaky-wave antenna is a curved aperture waveguide sidewall-emitting antenna.

4. The steerable, high-power microwave antenna of claim 1, further comprising:

a second trans-reflecting conical-sectional reflector, wherein the second trans-reflecting conical-sectional reflector is disposed spaced-apart and below said leaky-wave feed antenna; and a second twist-reflector operably associated with the second trans-reflecting conical-sectional reflector.

5. The steerable, high-power microwave antenna of claim 1, wherein the twist reflector includes a flat, microwave reflecting surface and a grill located in front of the microwave reflecting surface, wherein the grill and the microwave reflecting surface are disposed in spaced-apart and substantially parallel relationship to each other.

6. A compact, lightweight, steerable, high-power, microwave weapon, comprising:

a self-powered, microwave radiation source;

a forward-traveling, leaky-wave antenna coupled to the microwave radiation source;

a trans-reflecting conical-sectional reflector disposed spaced-apart and above said leaky-wave feed antenna and having a conical surface facing said leaky-wave feed antenna and formed of a plurality of electrical conductors held in parallel order in a grill; and a twist-reflector pivotally mounted opposite and spaced-apart from said conical surface of said trans-reflecting conical-sectional reflector and adapted to receive microwave energy reflected to it from said conical surface of said trans-reflecting conical-sectional reflector and to rotate the polarization of said microwave energy and reflect said microwave energy back to said trans-reflecting conical-sectional reflector for passing through said trans-reflecting conical-sectional reflector and forming a narrow, pencil-like beam of high energy radiation in polarized form extending outward from said conical surface of said trans-reflecting conical-sectional reflector.

7. The compact, lightweight, steerable, high-power, microwave weapon of claim 6, wherein the leaky-wave antenna is a flat-aperture waveguide sidewall-emitting antenna.

8. The compact, lightweight, steerable, high-power, microwave weapon of claim 6, wherein the leaky-wave antenna is a curved aperture waveguide sidewall-emitting antenna.

9. The compact, lightweight, steerable, high-power, microwave weapon of claim 6, further comprising:

a second trans-reflecting conical-sectional reflector, wherein the second trans-reflecting conical-sectional reflector is disposed spaced-apart and below said leaky-wave feed antenna; and a second twist-reflector operably associated with the second trans-reflecting conical-sectional reflector.

* * * * *